US005853360A

United States Patent [19]

Jeffrey et al.

[11] Patent Number: 5,853,360

[45] Date of Patent: Dec. 29, 1998

[54] METHOD AND APPARATUS FOR PRODUCING A GUSSETED CONTAINER

[75] Inventors: Richard F. Jeffrey, Keithville; Bradley R. Tilton; James A. Mahlum, both of Shreveport; Michael D. Wallace, Mooringsport; Bobby C. Taylor, Eros; Larry E. Reeves, West Monroe, all of La.; Glynn A. Blank, Maud, Tex.; Donald G. Lee, Keithville, La.

[73] Assignee: J & L Development, Inc., Keithville, La.

[21] Appl. No.: 491,470

[22] Filed: Jun. 16, 1995

[51] Int. Cl.[6] ..... B31B 1/06

[52] U.S. Cl. ..... 493/178; 493/179; 493/183; 493/243; 493/258

[58] Field of Search ..... 493/243, 248, 493/258, 405, 410, 416, 417, 436, 437, 438, 441, 177–183, 360, 396, 399–404, 442, 434–435

[56] References Cited

U.S. PATENT DOCUMENTS

| | | | |
|---|---|---|---|
| 2,899,873 | 8/1959 | Bombard | 493/179 |
| 4,874,125 | 10/1989 | Bates | 229/132 |
| 5,151,075 | 9/1992 | Beaulleu et al. | 493/179 |

*Primary Examiner*—Joseph J. Hail, III
*Assistant Examiner*—Anthony Ojini
*Attorney, Agent, or Firm*—Dorsey & Whitney LLP

[57] ABSTRACT

A method and apparatus for producing a gusseted container, which method includes the steps of feeding unfolded, corrugated paper, die cut blanks sequentially from the feed module of a corrugated paper box folding apparatus through the prefold, fold and final fold modules, applying glue to the die cut blanks, creasing three gusset areas of the blanks, gathering and pleating the gusset areas, folding a panel tab against the adjacent blank panel, pressing the folded gussets and panel tab against the glue on the blanks and folding the blanks and panel tab to define the gusseted container. The apparatus for producing the gusseted container includes lifting fingers or creasing bars for creasing the respective gusset areas of the die cut blanks, variable speed gathering wheels for gathering the gusset areas to define gussets, upper and lower skis for supporting and stabilizing the blanks, tracker wheels for further stabilizing the blanks on the lower skis, guide bars, fold bars and a folding shoe for biasing the gussets and a panel tab onto the respective adjacent panels of the die cut blanks, glue heads for applying glue to the gussets and panel tab prior to folding the gussets and panel tab against the panels, creasing swords for creasing the gusset panel margins and fold belts for folding the respective blank panels after the respective gussets have been glued to the panels.

27 Claims, 6 Drawing Sheets

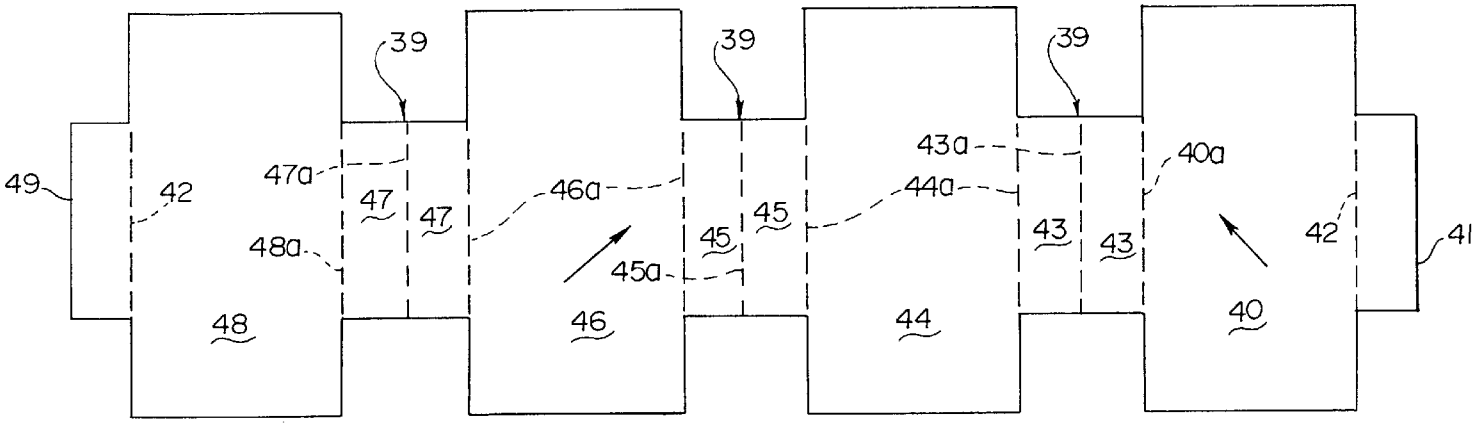
Fig. 11
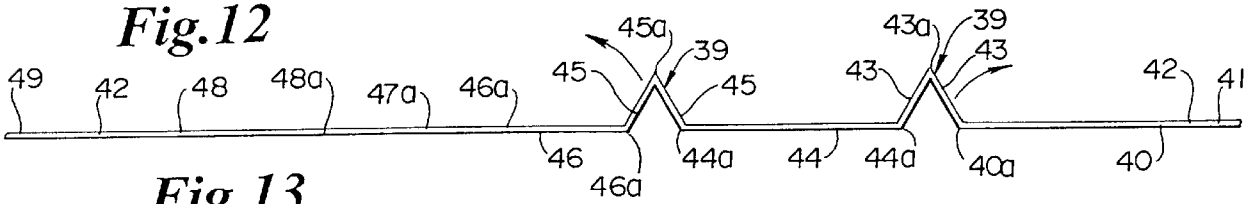
Fig. 12
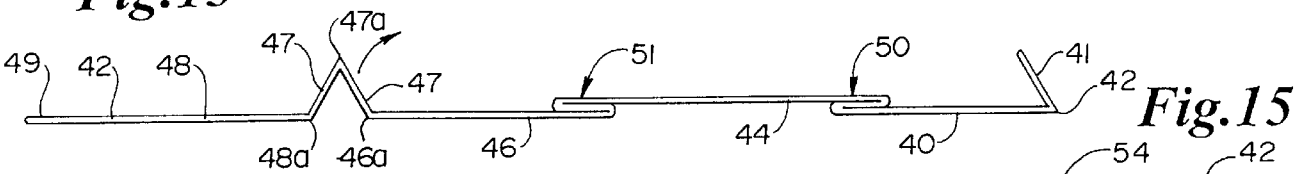
Fig. 13
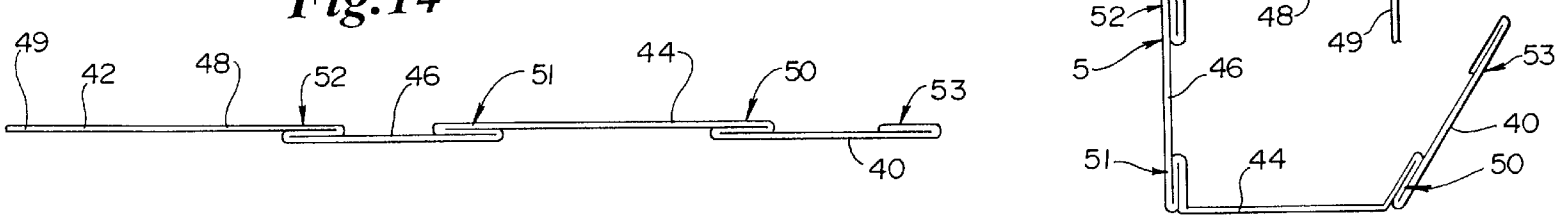
Fig. 14
Fig. 15

METHOD AND APPARATUS FOR PRODUCING A GUSSETED CONTAINER

BACKGROUND OF THE INVENTION

Field of the Invention

This invention relates to the folding of flat, die cut, corrugated paper blanks, and more particularly, to a method and apparatus for producing a gusseted container such as the container disclosed in U.S. Pat. No. 4,874,125, dated Oct. 17, 1989, to Howard M. Bates. The invention is characterized by a method and apparatus for producing a gusseted container from a flat die cut blank, which method includes the steps of feeding unfolded, flat blanks sequentially from the feed module or area of a corrugated paper box folding apparatus through the folding mechanism, such as a prefold module, fold module and final fold module, to gather, pleat, fold and glue three gusset segments or areas of the unfolded blanks and fold the adjacent die cut blank panels and one of the panel tabs to define the gusseted container. While the gusseted container can be pleated, glued and folded in substantially any conventional carton folding apparatus with the addition of the folding equipment of this invention, in a preferred embodiment the gusseted container is folded using the carton folding apparatus disclosed in U.S. Pat. No. 5,151,075. The steps of folding and gluing the gusseted container include feeding the unfolded blanks into a prefold module, applying glue to gusset and panel areas, creasing and gathering the respective gusset areas to define discrete gussets, gluing the gussets and a panel tab onto the respective adjacent blank panels and folding the panels flat for later assembly into a gusseted box having high crush-resistance. The apparatus for producing the gusseted container includes lower skis for supporting the flat die cut blanks, glue heads for applying glue to the gusset areas and panels of the blanks, lifting fingers, or creasing bars for creasing the respective gusset areas, variable speed gathering wheels for pleating and gathering the respective creased gusset areas into gussets, upper skis, guide bars, fold bars and ironing rollers for biasing the gussets onto the adjacent blank panel, a folding shoe for folding one of the panel tabs against the adjacent panel to define a gusset, creasing swords for creasing the blank panels at the gussets and fold belts for folding the respective panels after the gussets have been glued to the panels.

A typical corrugated paper box folding apparatus which may be utilized in the method and apparatus for producing a gusseted container of this invention includes multiple folder/gluer modules, including a feed module for receiving and delivering flat, unfolded die cut blanks and prefold, fold and final fold modules for effecting specific gluing and folding operations. A delivery module and a stacker unit may optionally be used for receiving and stacking the folded and glued blanks. Each of the folder/gluer modules is capable of being removed from the apparatus line and may be characterized by separate, independently-driven upper and lower belt mechanisms for driving the die cut blanks through that module. The feed module includes adjustable upper and lower feed assemblies and the remaining prefold, fold, and final fold modules include upper and lower carriages, which upper carriages may be adjusted upwardly with respect to the feed assembly and bottom carriages, respectively, and both carriages in the prefold, fold and final fold modules are laterally adjustable to accommodate blanks of various width. While the respective belts in each of the folder/gluer modules are independently driven, all belt drive motors are synchronized to insure that the belts operate at the same speed. The belt-carrying mechanisms in all of the folder/gluer modules are designed to facilitate optimum belt replacement without the necessity of dismantling the carrying mechanism.

Some of the problems which are inherent in the design of folded corrugated paper boxes is that of insufficient rigidity to withstand multiple stacking and/or rough handling during shipping and storage. This defect is largely corrected in the folded corrugated board carton detailed in U.S. Pat. No. 4,874,125, dated Oct. 17, 1989, to Howard M. Bates. The gusseted folding box is formed from a one-piece die cut blank of corrugated board and is provided with vertically-extending corner gusset elements which, in part, substantially increase the vertical crush strength of the box. The key to the rigidity and strength of this box is a one-piece blank fitted with gathered, pleated and glued corner gusset elements that extend substantially the full height of the expanded blank, which elements impart significantly-increased vertical crush strength to the box compared with the crush strength of essentially the same box, but lacking the stiffening gusset elements.

Accordingly, it is an object of this invention to provide a method and apparatus for producing a gusseted container such as the folding corrugated board container detailed in U.S. Pat. No. 4,874,125.

Another object of the invention is to provide a method for producing a gusseted container from a one-piece, flat, unfolded, die cut, corrugated paper blank, which method includes steps of applying glue to the appropriate gusset areas, tabs and panels of the blank, creasing the respective gussets to facilitate a bias in the gusset fold, gathering or pleating the gussets to accentuate the fold in the gusset areas of the blank, biasing and gluing the gussets and a panel tab to the adjacent panels, creasing the gusset-panel margins and folding the respective panels with respect to each other at the respective creased gusset margins to create the gusseted container.

Yet another object of this invention is to provide a process or method for producing a gusseted container, which method includes the steps of feeding flat, unfolded, die cut blanks from the feeding stage of a folder/gluer into the folding stage or stages of the folder/gluer, creasing, biasing and gathering selected gusseted areas in the blanks after applying glue to the gusseted areas, adjacent blank panels and a blank panel tab, biasing the gusseted areas and the panel tab against the adjacent panels and folding the panels into a flat configuration suitable for stacking and storage.

Still another object of this invention is to provide a method of producing a gusseted container using a conventional folder/gluer, or other apparatus designed to carry out this method, which method includes the steps of loading a selected quantity of unfolded, flat die cut blanks having flat gusset areas, in the feed section of the folder/gluer; dispensing the flat blanks one-by-one in a linear, horizontal plane into the folding section or sections of the folder/gluer; applying glue to selected portions of the unfolded blanks, including the gusset areas; creasing, gathering and pleating and stabilizing the gusset areas in sequence on supporting skis to define triple-thickness, glued gussets in the blanks; applying additional glue to selected portions of the gussets and a folded panel tab; biasing the gussets and the panel tab onto the adjacent panels of the blanks, respectively, and folding the blank panels at selected gusset margins into a flat configuration suitable for stacking and storage.

Another object of this invention is to provide an apparatus for producing a gusseted container using folder/gluer equipment, which apparatus includes glue guns or heads for applying glue to flat, die cut, corrugated paper blanks, creasing bars for creasing selected gusseted areas of the unfolded blank, variable speed gathering wheels for gathering the creased gusseted areas into double-thickness gussets, bending and folding bars and shoes for folding the gussets and at least one blank end tab against the glue ribbons on the adjacent blank panels and applying pressure to the glued, now triple-thickness gussets and a folding belt for folding the respective panels of the blank at selected folded and glued gussets to define a flat gusseted box suitable for storage.

A still further object of this invention is to provide an apparatus for producing a gusseted container, which apparatus is used in conjunction with a folder/gluer having a feed section and at least one folding section, the apparatus including creasing bars for sequentially creasing selected gusset areas in the flat, unfolded die cut corrugated paper blanks, lower skis for supporting the unfolded blanks as the blanks move in a horizontal plane linearly through the folding section of the folder/gluer, upper skis and stabilizing rollers for aligning and stabilizing the blanks, glue guns or heads for applying glue to selected panels and the gusset areas of the unfolded blanks, variable speed, gathering wheels for gathering or pleating the creased gussets in sequence, guide and fold bars and shoes for engaging and folding the double-thickness gussets and a carton tab against the blank panels, retainer bars, belts and ironing rollers for maintaining the gussets in position against the adjacent panels to facilitate drying of the glue and folding belts for folding respective panels with respect to each other with the gussets in position at the corners of the gusseted box.

SUMMARY OF THE INVENTION

These and other objects of the invention are provided in a new and improved method and apparatus for producing a gusseted container, which method includes the steps of feeding a quantity of unfolded die cut, corrugated paper blanks in sequence into the folding modules or sections of a folder/gluer, biasing gusset or pleated areas of the unfolded blanks upwardly, applying hot and/or cold glue to the gusset areas and blank panels in selected locations, gathering the gusset areas in sequence into doublethickness, glued layers, biasing the double-thickness gussets and a single panel tab onto the adjacent panels, respectively, of the blanks to facilitate drying of the glue, folding the respective panels into a box-like configuration with the gussets located at the corners of the box and flattening the box into a storage configuration. The apparatus for effecting these steps includes creasing bars for biasing the gusset areas upwardly with respect to the horizontal plane of travel as the unfolded die cut blanks advance through the folding sections or modules of the folder/gluer, glue heads and supply apparatus for applying hot melt and cold glue to the gusset areas and selected panel segments of the blanks, variable speed gathering wheels for gathering or pleating the gusset areas into double-thickness gussets, upper and lower skis for supporting and guiding the unfolded blanks through the folded section or sections, guiding rollers and bars and folding bars and shoes for biasing the gussets and a panel tab on an adjacent panel while the glue dries, to maintain the gussets in position, creasing swords for creasing the blanks at selected gusset-panel intersections and folding belts for folding the respective blank panels into a flat configuration with the gussets preglued at the corners thereof, to facilitate storing the flattened boxes.

BRIEF DESCRIPTION OF THE DRAWINGS

The invention will be better understood by reference to the accompanying drawings, wherein:

FIG. 11 is a top view of a typical unfolded, die cut, corrugated paper blank as stacked in the feed section or unit of the folder/gluer;

FIG. 12 is a side view of the blank illustrated in FIG. 5, with a pair of gusset areas biased upwardly, indicating the direction of fold of the resulting gussets as the die cut blank progresses through the folding elements of the folder/gluer;

FIG. 13 is a side view of the blank illustrated in FIG. 12, more particularly illustrating gluing of the first two gussets in position on respective adjacent panels of the blank, bending of a panel tab toward the adjacent panel and biasing of the third gusset area upwardly;

FIG. 14 is a side view of the die cut blank illustrated in FIG. 13, with the panel tab folded inwardly and glued in position to define an end gusset and the third gusset also folded and glued in position against the adjacent panel; and FIG. 15 is a side view of the blank illustrated in FIG. 14, more particularly illustrating folding of the respective carton blanks at the gussets to faciliate folded, glued, triple-thickness gussets at each corner of the folded blanks.

DESCRIPTION OF THE PREFFERED EMBODIMENTS

Figure 1:
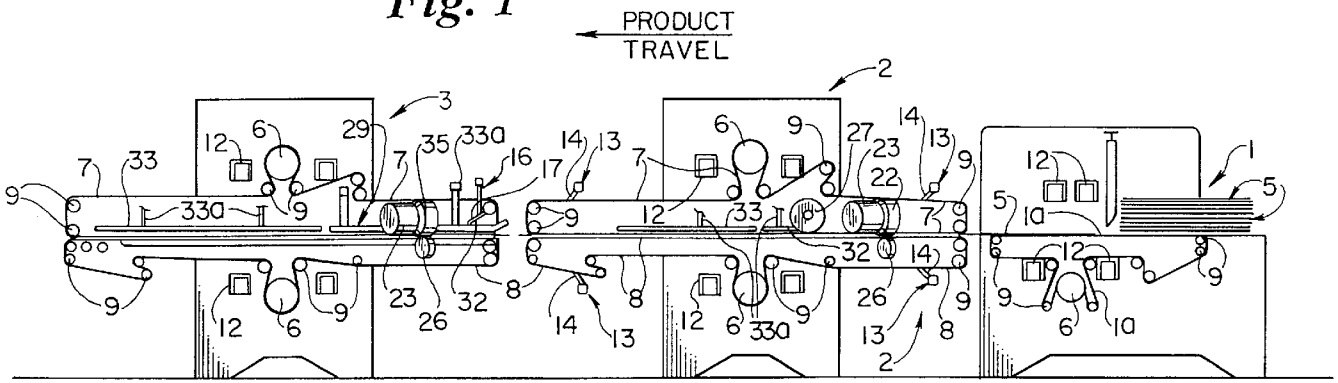
FIG. 1 is a side sectional view of a preferred embodiment of the method and apparatus of producing a gusseted container, illustrated in connection with a folder/gluer detailed in U.S. Pat. No. 5,151,075.
Figure 2:
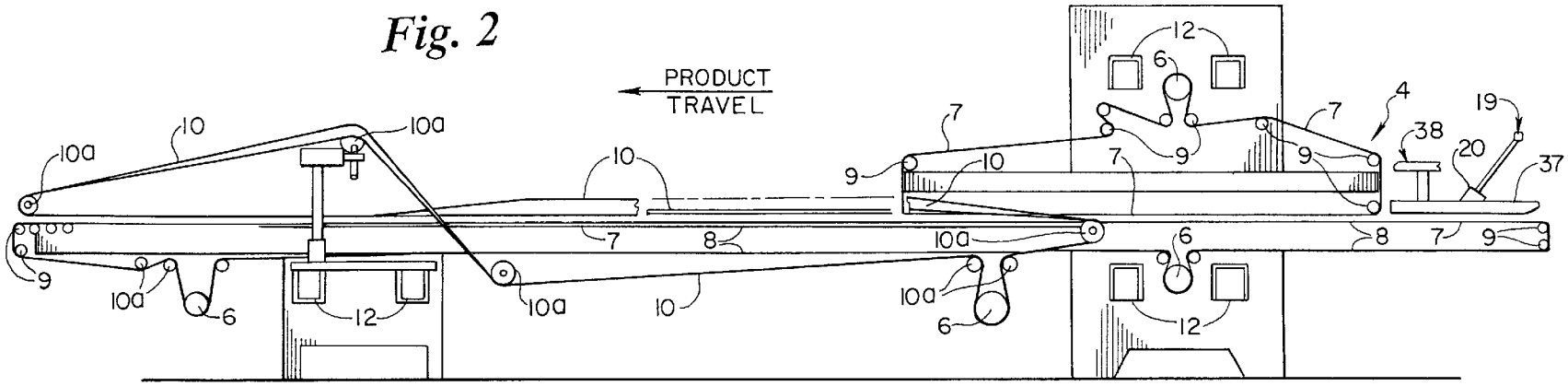
FIG. 2 is a side view of the final fold module of the folder/gluer detailed in U.S. Pat. No. 5,151,075, with elements of the folding apparatus of this invention mounted thereon to facilitate a final folding of the respective panels in the gusseted container.
Figure 3:
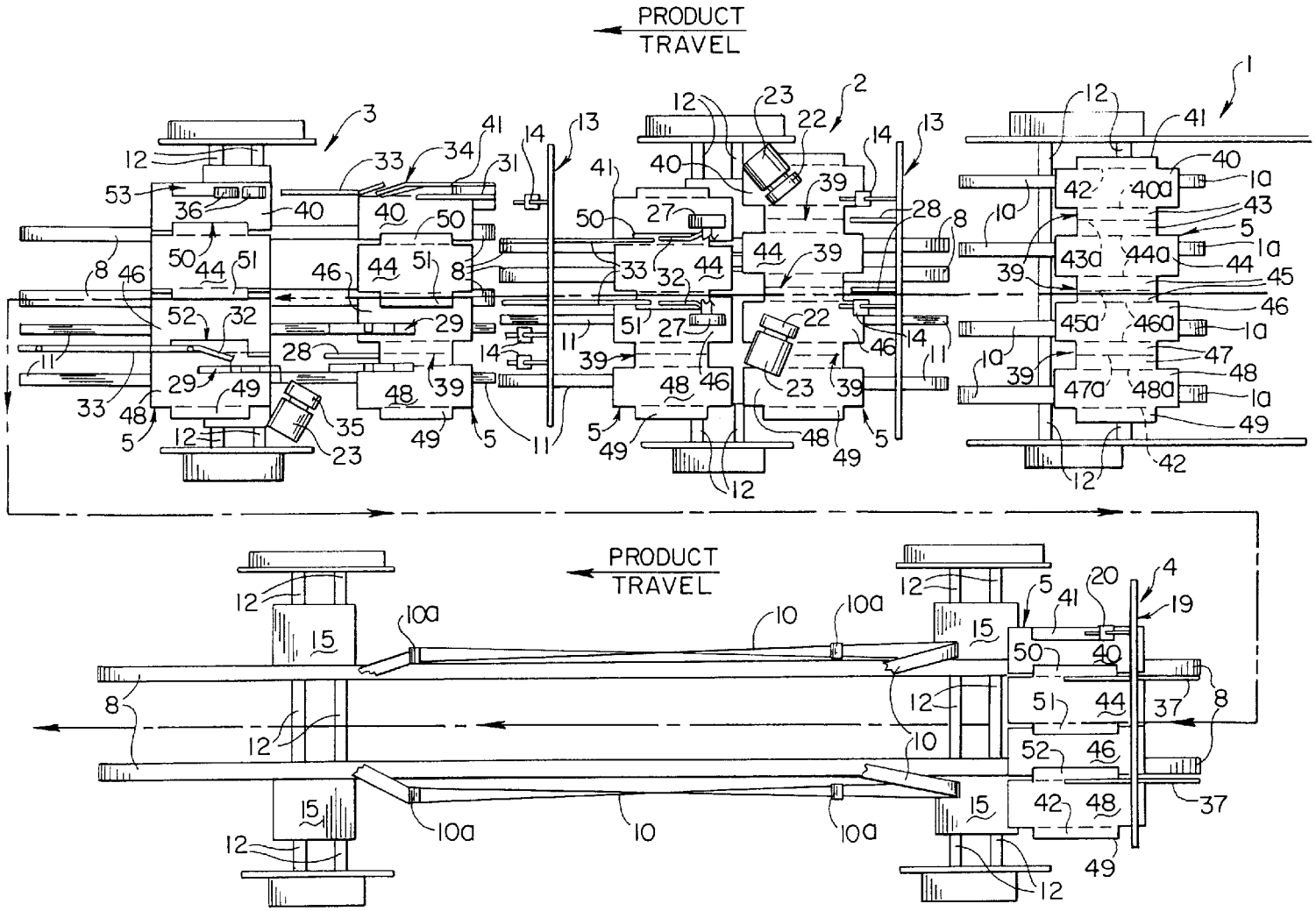
FIG. 3 is a top view of the lower carriage and roller systems in the feed, prefold, fold and final fold modules of the folder/gluer illustrated in U.S. Pat. No. 5,151,075, with the gusseted container-producing apparatus of this invention mounted thereon.
Figure 4:
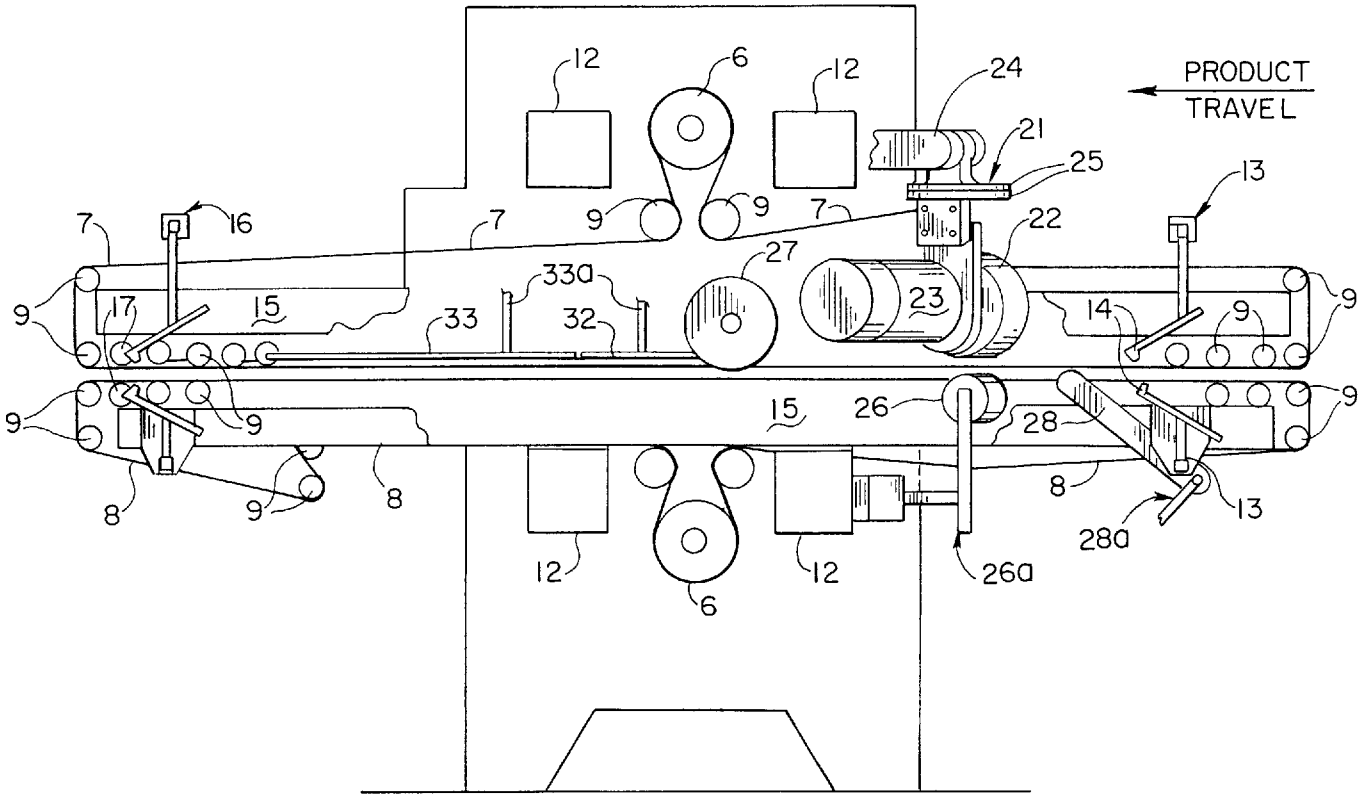
FIG. 4 is an enlarged, side sectional view of the prefold module of the folder/gluer illustrated in U.S. Pat. No. 5,151,075, more particularly illustrating a pair of glue heads, a creasing bar, a gathering wheel, a tracker wheel, guide bars and folding bar elements of the apparatus for producing the gusseted container of this invention.

Referring initially to FIGS. 1–4 of the drawings, the method and apparatus for producing a gusseted container of this invention are detailed using the folder/gluer detailed and described in U.S. Pat. No. 5,151,075, modified with certain gusseted container-producing apparatus as follows: the folder/gluer apparatus is characterized by a feed module 1, fitted with multiple feed belts la and adapted to contain multiple stacked, flat, unfolded, die cut corrugated paper blanks 5. A prefold module 2 is positioned adjacent to the feed module 1 and is designed to receive the unfolded blanks 5 from the feed module 1 in sequence, as hereinafter further described. A fold module 3 is likewise positioned adjacent to the prefold module 2 and is designed to receive the blanks 5 in various stages of folding, as further hereinafter described. A final fold module 4 is illustrated in FIGS. 2 and 3 and is designed to further fold the blanks 5 to complete the folding process, as further hereinafter described. In each of the feed module 1, prefold module 2, fold module 3 and final fold module 4, belt drive motors 6 receive and drive the respective drive belts, which are detailed in the drawings as a pair of top drive belts 7 and a corresponding pair of bottom drive belts 8. It is understood that the top drive belts 7 and bottom drive belts 8 are each continuous, or endless, as illustrated in the drawings. Various belt idler rollers 9 are positioned in the feed module 1, prefold module 2, fold module 3 and the final fold module 4 for receiving, supporting and guiding the top drive belts 7 and bottom drive belts 8, respectively. A pair of fold belts 10 are provided in the final fold module 4 in addition to the top drive belts 7 and bottom drive belts 8 and the fold belts 10 are supported and positioned by the fold belt rollers 10*a*, illustrated in FIGS. 2 and 3. A set of lower skis 11 are provided in each of the prefold module 2, fold module 3 and the final fold module 4 to support the respective blanks 5 as they leave the feed module 1 and are delivered to the prefold module 2 in sequence and to support the various configurations of the blanks 5 as they move through the prefold module 2, fold module 3 and the final fold module 4 between the respective top drive belts 7 and bottom drive belts 8, as further hereinafter described. Module beams 12 span each of the feed module 1, prefold module 2, fold module 3 and the final fold module 4, for support purposes, as further illustrated in FIGS. 1–3. A pair of prefold glue manifolds 13 are positioned on the blankreceiving and discharging ends of the prefold module 2, both above and below the plane of the blanks 5, to facilitate extension of four prefold glue heads 14 from the manifold 13 and application of glue to desired selected top and bottom areas of the blanks 5 as the blanks 5 pass between the respective manifolds 13. Furthermore, a pair of creasing bars 28 are mounted by means of creasing bar mounts 28*a* on the frame 15 of the prefold manifold 2, and one end of the creasing bars 28 project upwardly through the plane of movement of the unfolded blanks 5 for creasing purposes, as hereinafter further described. A pair of gathering wheel motors 23 are suspended from the frame of the prefold module 2, preferably in adjustable relationship by means of gathering wheel brackets 21 and adjusting plates 25, attached to a wheel mount frame 24, as illustrated in FIG. 4 and each of the gathering wheel motors 23 rotatably mount a pair of polyurethane primary variable speed gathering wheels 22. As illustrated in FIGS. 1, 3 and 4, the primary variable speed gathering wheels 22 are supported by underlying nip wheels 26, mounted on the module frame 15 by means of nip wheel brackets 26*a*. The primary variable speed gathering wheels 22 are skewed with respect to the longitudinal movement of the unfolded blanks 5 to facilitate gathering of the respective created gusset areas 39 into double-layered, pleated gussets for gluing to the adjacent panel of the blanks 5, and defining triple-layered, pleated gussets, as further hereinafter described. A pair of tracker wheels 27 is mounted for free rotation on wheel shafts 27*a*, attached to the module frame 22 of the prefold module 2 in any convenient manner, for engaging the respective blanks 5 and stabilizing and re-aligning the blanks 5 between the respective top drive belts 7 and bottom drive belts 8. A pair of gusset fold bars 32 are positioned adjacent to and on each side of the respective top drive belts 7 and bottom drive belts 8. The gusset fold bars 32 are designed to guide the respective creased pleats, which have been gathered by the primary gathering wheels 22 into double-thickness gussets, into folded configuration against the adjacent carton panel, thus assisting in gluing the respective pleats into gusset configuration. A second prefold glue manifold 13 is provided in the exit section of the prefold module 2 and serves to mount three additional pairs of prefold glue heads 14, which are positioned above and below the plane of the top drive belts 7 and bottom drive belts 8 and thus, the blanks 5. Accordingly, the prefold glue heads 14 are designed to apply glue to a specific area of the blanks 5 as they pass beneath the prefold glue gun manifold 13, as further hereinafter described. A fold glue manifold 16, fold glue head 17 and guide bar 31 are positioned in the entrance segment of the fold module 3, along with a folding shoe 34, both of the latter elements of which are designed to fold a first panel tab 41 of the blanks 5, against the glue-laden adjacent carton first panel 40 as the blanks 5 move from the prefold module 2 into the fold module 3. Upper skis 29, mounted on the module frame 15 of the fold module 3 by means of upper ski brackets 30 and bracket adjusting bars 30*a*, serve to help stabilize the blanks 5 on the lower skis 11. A tab retainer bar 33 is located behind the folding shoe 34 and serves to complete the folding of the blank first panel tab 41 against the adjacent first blank panel 40. Another creasing bar 28 is mounted in the fold module 3 by means of the creasing bar mount 28*a* for engaging the third pleat in the blanks 5 and creasing the pleat. A secondary gathering wheel 35 is located between the creasing bar 28 and the gusset fold bar 32 to facilitate gathering of the third pleat to define the third gusset 52, which is folded by the gusset fold bar 32, as described above. A gusset fold bar 32 and tab retainer bar 33 are mounted in the fold module 3 by means of bar brackets 33*a*, to facilitate folding of the gathered third gusset 52 into its proper position on the adjacent third panel 46 of the blanks 5. A pair of upper and lower ironing rollers 36, rotatably mounted on ironing roller brackets 36*a*, receive the glued blank first panel tab 41 and apply additional pressure to the glued first panel tab 41 at the end of each blank 5. The blanks 5 are delivered in sequence to the final fold module 4 with all three gussets in folded and glued configuration. A pair of creasing swords 37, each connected to the module frame 15 of the final fold module 4 by means of a creasing sword frame 38, are provided in the final fold module 4 and operate to crease certain panel folds in the blanks 5 and a final fold glue head 20, suspended from a final fold/glue manifold 19, applies glue to the previously folded first panel tab 41, preparatory to gluing of that first panel tab 41 to the oppositely-disposed fourth panel tab 49 on the opposite end of the blanks 5, to define the fourth gusset 53 and complete the gusseted container 54. A pair of fold belts 10, mounted on fold belt rollers 10*a* in the final fold module 4, then operate to fold the blanks 5 into the completed gusseted containers.

Referring now to FIGS. 3 and 11 of the drawings, the flat, unfolded blanks 5 each include a first panel 40, having a first panel tab 41 extending therefrom along a tab fold line 42. A first pleat 43 is located adjacent to the first panel 40 and between the first panel 40 and the second panel 44 at a first gusset area 39. The first pleat 43 is characterized by a first pleat fold line 43*a* and a second pleat 45 is defined between the flat second panel 44 and third panel 46 at a second gusset area 39. Like the first pleat 43, the second pleat 45 includes a second pleat line 45*a*, lying adjacent to a second panel fold line 44*a* of the second panel 44. A third pleat 47 is positioned in the blank 5 at a third gusset area 39 and lies between the third panel 46 and the fourth panel 48. The third panel 46 is joined to the third pleat 47 along a third panel fold line 46*a*, while the third pleat 47 is also joined to the fourth panel 48 along a fourth panel fold line 48*a*. A third pleat fold line 47*a* divides the third pleat 47 into equal segments. A fourth panel tab 49 projects from the opposite side of the fourth panel 48 along a tab fold line 42, in the same manner as the first panel tab 41 projects from the first panel 40. Accordingly, it will be appreciated by a consideration of FIGS. 3 and 11 of the drawings that the unfolded blanks 5 are each symmetrical in appearance, with the first panel 40, second panel 44, third panel 46 and fourth panel 48, which may be equal in size and the gusset areas 39, which include the first pleat 43, second pleat 45 and third pleat 47, also equal in size.

Referring now to FIGS. 12–15 of the drawings, the respective gusset areas 39 and first pleat 43, second pleat 45 and third pleat 47 of the blanks 5 are creased, gathered and folded in sequence to define a first gusset 50, second gusset 51 and a third gusset 52, as the unfolded blanks 5 illustrated in FIGS. 3 and 11 move from the feed module 1 through prefold module 2, fold module 3 and the final fold module 4, as hereinafter further described. Furthermore, as illustrated in FIG. 15, the final fold module 4 operates to fold the blanks 5 illustrated in FIG. 14 into a flat variation of the box-like configuration illustrated in FIG. 15, with the first gusset 50, second gusset 51 and third gusset 52 located at the corners of the box and the glued and folded first panel tab 41 and fourth panel tab 49 serving as the fourth gusset 53.

Figure 5A:
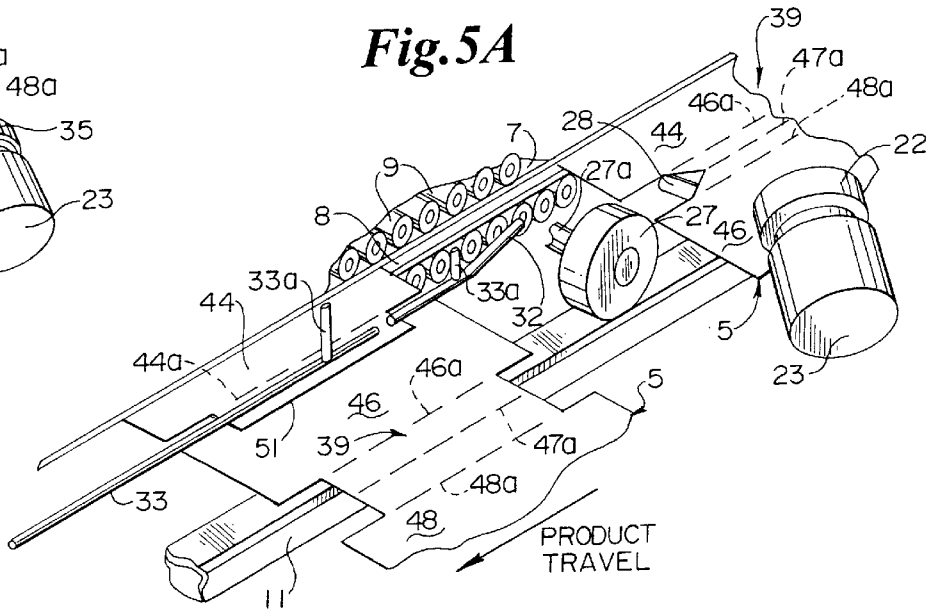
FIG. 5A is a perspective view, partially in section of typical gathering roller, tracker wheel, folding bar and guide bar elements of the gusset container apparatus mounted in the prefold module.
Figure 5:
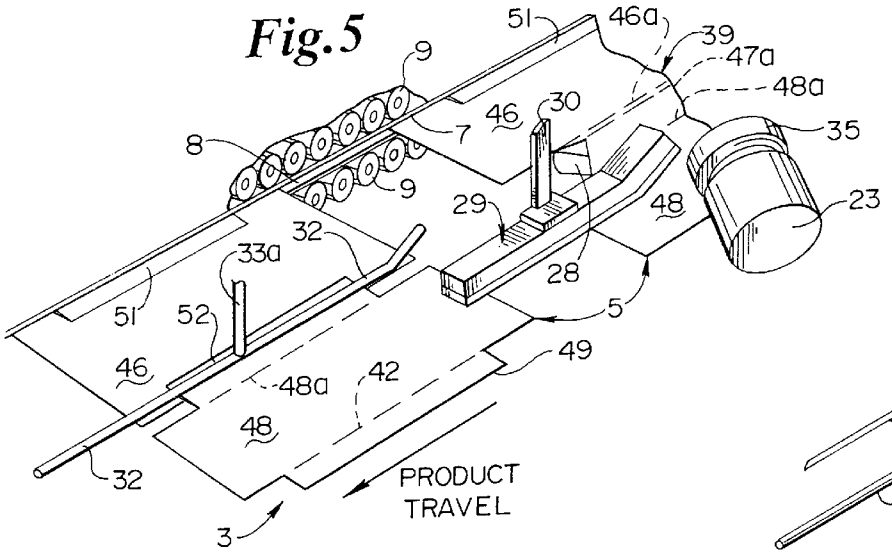
FIG. 5 is a perspective view, partially in section, of typical creasing bars, gathering wheel, top ski and guide bar elements of the gusset container-production apparatus mounted on the fold module of the folder/gluer.
Figure 6:
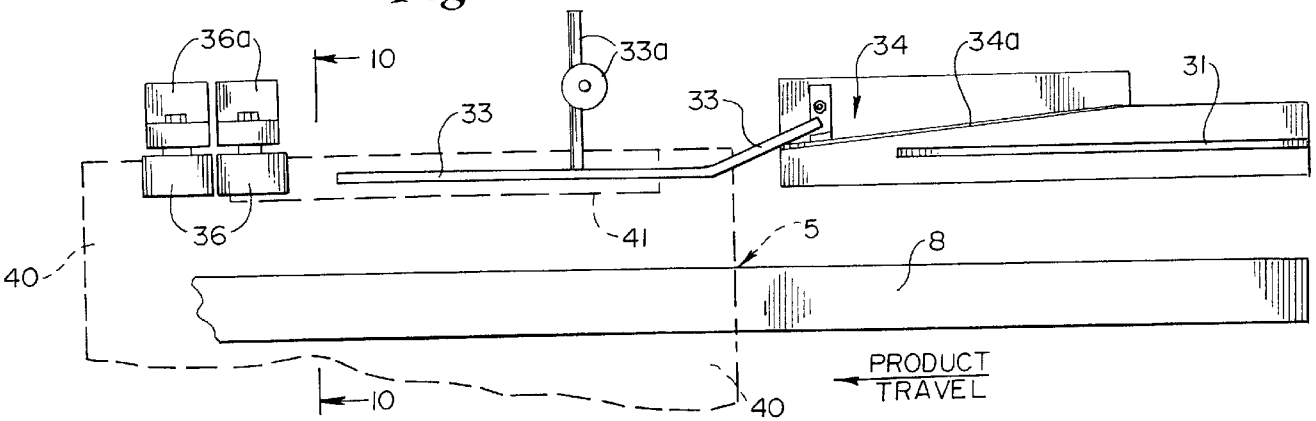
FIG. 6 is a side view of typical tab guide bar, folding shoe, folding bar and ironing roller elements of the gusset container apparatus mounted on the fold module of the folder/gluer.
Figure 7:
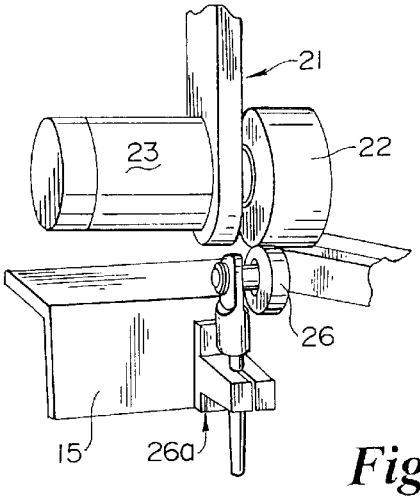
FIG. 7 is a perspective view, partially in section, of a typical gathering wheel and nip roller combination for gathering the respective gusseted areas into double layer gussets in both the fold and prefold modules.
Figure 10:
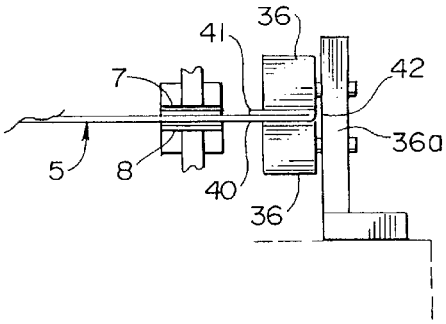
FIG. 10 is an end sectional view of the ironing roller and upper and lower ski elements of the gusseted container apparatus mounted on the fold module.
Figure 8:
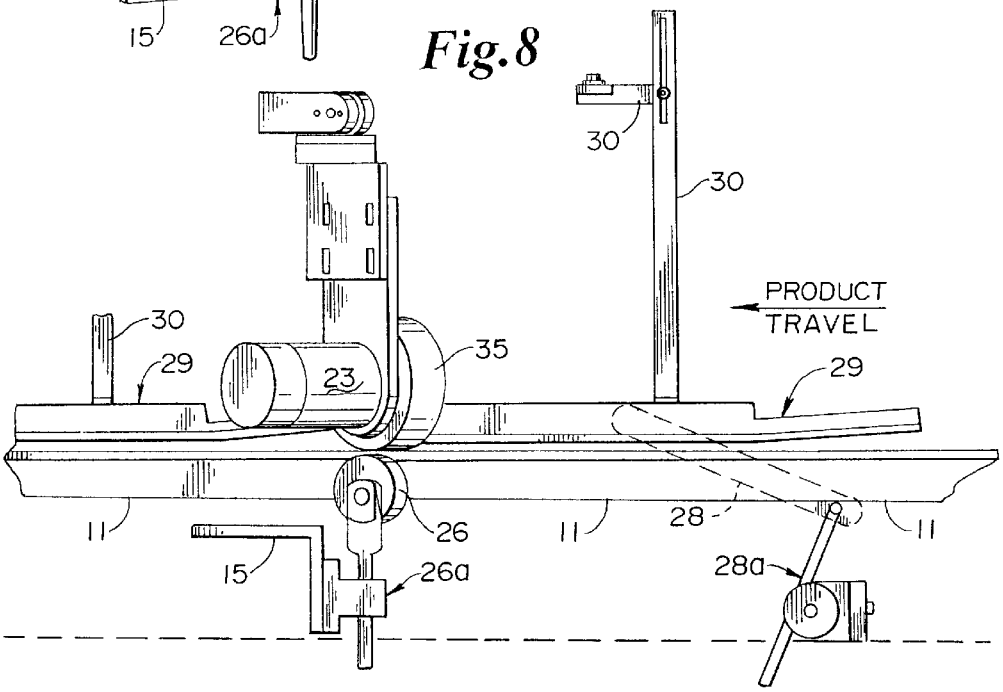
FIG. 8 is a side view, partially in section, of typical creasing bar, upper and lower ski, gathering wheel and nip roller elements of the gusseted container apparatus mounted on the fold module.
Figure 9:
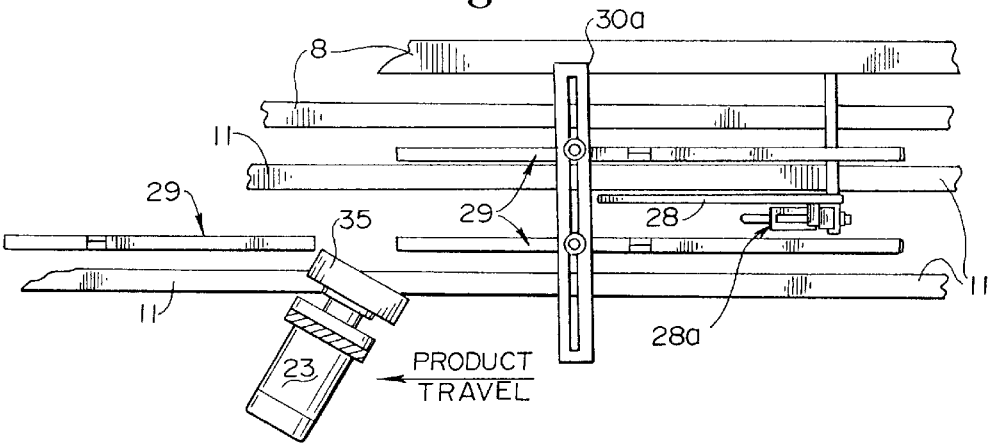
FIG. 9 is a top view of the gusseted container-producing apparatus illustrated in FIG. 8.

In operation, and referring again initially to FIGS. 1–4 and 11–15 of the drawings, the gusseted container 54 illustrated in FIG. 15 of the drawings is constructed as follows: a desired number of the flat, unfolded die cut, corrugated paper blanks 5 are first stacked in the feed module 1 of the folder/gluer apparatus, as illustrated in FIGS. 1–3. The folder/gluer is then activated such that the respective belt drive motors 6 drive the corresponding feed belts la in the feed module 1, as well as the top drive belts 7 and bottom drive belts 8 in each of the feed module 1, prefold module 2, fold module 3 and the final fold module 4, to facilitate advancement of the respective blanks 5 in sequence from the feed module 1 to position between the respective sets of top drive belts 7 and bottom drive belts 8, to the prefold module 2, the fold module 3 and the final fold module 4 at a preselected common belt speed. As each unfolded blank 5 is dispensed from the feed module 1 into the prefold module 2, the first set of prefold glue heads 14, mounted on the prefold glue manifold 13, located above and below the line of travel of the unfolded blanks 5, dispense a quantity of cold glue on the bottom surfaces of the first pleats 43 and second pleats 45, the lower edge of the top surface of the first panel 40 adjacent to the first panel fold line 40*a* and on the third panel 46 adjacent to the third panel fold line 46*a*, of the die cut blank 5 illustrated in FIG. 11. During this gluing sequence, as illustrated in FIGS. 5A and 8, a pair of creasing bars 28, positioned immediately below the first pleat line 43*a* of the first pleat 43 and the second pleat fold line 45*a* of the second pleat 45, bias the center of these respective gusset areas 39 upwardly as the unfolded blanks 5 approach the two primary gathering wheels 22, driven by the corresponding gathering wheel motors 23. The speed of the gathering wheel motors 23 is adjusted to rotate the variable speed primary gathering wheels 22 at a rotational speed which is faster than the linear movement of the creased blanks 5 through the prefold module 2, to facilitate "gathering" of the respective gusset areas 39 at the first pleat 43 and second pleat 45, and define a double-thickness first gusset 50 and second gusset 51. The angle of incidence of each gathering wheel 22 with respect to the line of travel of the blanks 5 may also be adjusted by means of the adjusting plates 25 in the gathering wheel brackets 21, connected to the wheel mount frame 24. As the first gusset 50 and second gusset 51 are pleated, gathered and shaped in the moving blanks 5 as illustrated in FIGS. 3 and 12, they engage a parallel pair of gusset fold bars 32 located on either side of the top drive belts 7 and bottom drive belts 8 and the curved frontal portion of the gusset fold bars 32 force the gathered first gusset 50 against the pre-applied glue located on the first panel 40 and the second gusset 51 against the freshly applied glue on the third panel 46. The first gusset 50 and second gusset 51 then engage the longer tab retaining bars 33, respectively, also located on each side of the top drive belts 7 and bottom drive belts 8 as illustrated in FIG. 5*a*, to maintain the first gusset 50 against the first panel 40 and the second gusset 51 against the third panel 46 and allow the glue to dry or begin drying. At the same time, the parallel tractor wheels 27, also spanning the top drive belts 7 and bottom drive belts 8, serve to stabilize and position the blanks 5 in the proper aligned relationship on the lower skis 11 between the top drive belts 7 and bottom drive belts 8, as the blanks 5 traverse the prefold module 2. As the blanks 5 exit the prefold module 2, they pass between a second set of prefold glue heads 14, located on the corresponding prefold glue manifold 13 positioned above and below the line of travel of the blanks 5. Cold and hot glue is applied from these prefold glue heads 14 to the top surface of the top edge of the first panel 40 adjacent to the tab fold line 42 and cold glue to the top surface of the third panel 46 adjacent to the third pleat 47 at the corresponding third panel fold 46*a*, as well as to the bottom surface of the third pleat 47. The blanks 5 then sequentially move from the prefold module 2 into the fold module 3 by transfer between the respective sets of top drive belts 7 and bottom drive belts 8. Since the first gusset 50 and second gusset 51 have been prefolded and glued to the first panel 40 and the third panel 46, respectively, a third creasing bar 28 is positioned beneath the gusset area 39 corresponding to the third pleat 47, and between the upper skis 29, to crease the third pleat 47 at the third pleat fold line 47*a*, as illustrated in FIGS. 5 and 8. Simultaneously, the first gusset 50 and second gusset 51 move between the respective top drive belts 7 and bottom drive belts 8 in the fold module 3 to facilitate additional compression and drying of the glue therein. As illustrated in FIGS. 3 and 5, the upward-standing third pleat fold line 47*a* is then "gathered" and pleated by the variable speed secondary gathering wheel 35, driven by a gathering wheel motor 23, as each blank 5 slides between the respective upper skis 29 and lower skis 11. Furthermore, as illustrated in FIGS. 3 and 6, as the blanks 5 approach the variable speed secondary gathering wheel 35 in sequence, the shoe plate 34*a* of the folding shoe 34 engages the front edge of the yet unfolded first panel tab 41 and causes it to fold along the tab fold line 42 as the adjacent first panel 40 is stabilized by the tab guide bar 31. This fold is completed by the tab retainer bar 33, located immediately behind the folding shoe 34 and the glue which was previously applied to the first panel 40 just inside the tab fold line 42, serves to secure the first panel tab 41 on the first panel 40 as the first panel tab 41 rides beneath the corresponding tab retainer bar 33. The ironing rollers 36 serve to complete the compression and gluing of the first panel tab 41, as illustrated in FIGS. 6 and 10. Accordingly, while the gusset area 39 corresponding to the third pleat 47 is being gathered by the variable speed secondary gathering wheel 35, the first panel tab 41 is being glued to the first panel 40 by pressure exerted through the tab retainer bar 33 and the ironing rollers 36. The third gusset 52 created by the gathering action of the variable speed secondary gathering wheel 35 at the third pleat 47, is then folded against the third panel 46 opposite the second gusset 51 by means of the gusset fold bar 32. The third gusset 52 is maintained beneath the corresponding tab retainer bar 33, which is aligned with the gusset fold bar 32 in the fold module 3, to compress the third gusset 52 and dry the glue which was previously applied to the third panel 46 by means of the corresponding one of the fold glue heads 17. Accordingly, as the respective blanks 5 exit the fold module 3, the first panel tab 41 has been glued securely to the first panel 40 facing the previously glued first gusset 50, while the second gusset 51 and the third gusset 52 are similarly secured in facing relationship to the corresponding third panel 46, as illustrated in FIG. 14. The fourth panel tab 49, extending from the fourth panel 48, remains unfolded as the blanks 5 enter the final fold module 4, as illustrated in FIGS. 2, 3 and 14. As the blanks 5 enter the final fold module 4, the final fold glue head 20, extending from the corresponding final fold glue manifold 19, applies cold glue to the exposed top surface of the previously folded and glued first panel tab 41, for future engagement with the yet unfolded and oppositelydisposed fourth panel tab 49, extending from the fourth panel 48. At the same time, the parallel creasing swords 37 crease the now aligned first panel fold line 40*a* and second panel fold line 44*a* lying adjacent to the first gusset 50 and the common third panel fold line 46*a* and fourth panel fold line 48*a* lying adjacent to the third gusset 52, to facilitate folding of the blanks 5 in sequence into a flat configuration which may be opened to define the gusseted container 54, illustrated in FIG. 15 of the drawing. When the blanks 5 are so folded by the fold belts 10, the fourth panel 49 may be manually bent downwardly as illustrated in FIG. 15 and the first panel tab 41 manually applied to the fourth panel tab 49, for gluing the two together, shaping the fourth gusset 53 and completing the gusseted container 54. The gusseted container 54 as illustrated in FIG. 15 may then be flattened for storing and handling purposes.

It will be appreciated by those skilled in the art that the apparatus detailed in this invention for producing a gusseted container may be mounted on substantially any folder/gluer or other folding apparatus known to those skilled in the art, the folder/gluer detailed in U.S. Pat. No. 5,151,075, being described herein for purposes of illustration only. Accordingly, it will be appreciated by those skilled in the art that substantially any feed module may be utilized to receive the unfolded die cut corrugated paper blanks 5 and feed these unfolded blanks 5 sequentially to a single fold module or multiple fold modules equipped with the lower skis 11 and upper skis 29 and using the respective creasing bars 28, prefold glue heads 14, fold glue heads 17 and the final fold glue head 20, along with the corresponding variable speed primary gathering wheels 22 and variable speed secondary gathering wheel 35, as well as the respective nip wheels 26, tracker wheels 27, tab guide bars 31, gusset fold bars 32, tab retainer bars 33, folding shoe 34, ironing rollers 36 and creasing swords 37, to effect the folding operations heretofore described.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A method of producing gusseted containers comprising the steps of providing a plurality of unfolded blanks each having a panel tab at each end, an outside panel connected to each of said panel tabs respectively, a pair of inside panels disposed inwardly of said outside panels a first gusset area positioned between and connected with one of said outside panels and one of said inside panels, a second gusset area positioned between and connected with the other of said outside panels and the other of said inside panels and a third gusset area positioned between and connected with said pair of inside panels; advancing said unfolded blanks, sequentially along a linear path through a box folding apparatus in a substantially horizontal plane; applying glue to said gusset areas and to selected ones of said outside panels and said inside panels while said inside and said outside panels are in said horizontal plane or a plane parallel to said horizontal plane; gathering said gusset area so that said gusset areas are out of said horizontal plane and folding said panel tab and said gusset areas against said glue on said selected ones of said outside panels and said inside panels to define gussets in said blank; and folding said outside panels and said inside panels at said gussets to define the gusseted container.

2. The method according to claim 1 comprising the step of creasing said gusset areas for biasing said gusset areas out of said horizontal plane prior to said gathering of said gusset areas.

3. The method according to claim 1 comprising the step of creasing said outside panels and said inside panels at said gussets for biasing said outside panels and said inside panels out of said horizontal plane at said gussets prior to said folding of said outside panels and said inside panels at said gussets.

4. The method according to claim 1 comprising the steps of:

(a) creasing said gusset areas for biasing said gusset areas out of said horizontal plane prior to said gathering of said gusset areas; and (b) creasing said outside panels and said inside panels at said gussets for biasing said outside panels and said inside panels out of said horizontal plane at said gussets prior to said folding of said outside panels and said inside panels at said gussets.

5. The method according to claim 1 comprising the step of applying pressure to said gussets for setting the glue in said gussets and between said gussets and said selected ones of said outside panels and said inside panels.

6. The method according to claim 5 comprising the step of creasing said gusset areas for biasing said gusset areas out of said horizontal plane prior to said gathering of said gusset areas.

7.The method according to claim 5 comprising the step of creasing said outside panels and said inside panels at said gussets for biasing said outside panels and said inside panels out of said horizontal plane at said gussets prior to said folding of said outside panels and said inside panels at said gussets.

8. The method according to claim 5 comprising the steps of:

(a) creasing said gusset areas for biasing said gusset areas out of said horizontal plane prior to said gathering of said gusset areas; and (b) creasing said outside panels and said inside panels at said gussets for biasing said outside panels and said inside panels out of said horizontal plane at said gussets prior to said folding of said outside panels and said inside panels at said gussets.

9. The method according to claim 1 comprising the step of stabilizing the blank in said linear, substantially horizontal plane after said gathering and pleating of said gusset areas.

10. The method according to claim 9 comprising the step of creasing said gusset areas for biasing said gusset areas out of said horizontal plane prior to said gathering of said gusset areas and creasing said outside panels and said inside panels at said gussets for biasing said outside panels and said inside panels out of said horizontal plane at said gussets prior to said folding of said outside panels and said inside panels at said gussets.

11. The method according to claim 9 comprising the step of applying pressure to said panel tab and said gussets for setting the glue in said gussets and between said gussets and said selected ones of said outside panels and said inside panels.

12. The method according to claim 11 comprising the steps of:

(a) creasing said gusset areas for biasing said gusset areas out of said horizontal plane prior to said gathering of said gusset areas; and (b) creasing said outside panels and said inside panels at said gussets for biasing said outside panels and said inside panels out of said horizontal plane at said gussets prior to said folding of said outside panels and said inside panels at said gussets.

13. The method of claim 1 wherein said step of folding said outside and inside panels includes folding said outside panels out of said horizontal plane.

14. The method of claim 13 including folding said outside panels out of said horizontal plane while said inside panels remain in said horizontal plane or a plane parallel to said horizontal plane.

15. The method of claim 13 including the step of applying glue to one of said panel tabs for connection to the other of said panel tabs.

16. The method of claim 1 including the step of applying glue to one of said panel tabs for connection to the other of said panel tabs.

17. The method of claim 1 including folding said panel tab and said gusset areas against said glue on said selected ones of said outside panels and said inside panels while said inside and said outside panels are in said horizontal plane or a plane parallel to said horizontal plane.

18. The method of claim 17 wherein said step of folding said outside and inside panels includes folding said outside panels out of said horizontal plane.

19. The method of claim 18 including folding said outside panels out of said horizontal plane while said inside panels remain in said horizontal plane or a plane parallel to said horizontal plane.

20. Apparatus for producing a gusseted container from an unfolded blank having predetermined gusset areas, said apparatus comprising means for advancing the unfolded blank sequentially along a linear path in a substantially horizontal plane; glue application means for applying glue to the blank; gathering wheels mounted in angular relationship with respect to said linear path for gathering the predetermined gusset areas of the blank to define gussets in the blank; folding means for folding the gussets against the glue on the blank; retaining means for applying pressure to the gussets and facilitating drying of the glue; and folding belt means for engaging the blank and folding the blank at the gussets to define the gusseted container.

21. The apparatus of claim 20 comprising gusset area creasing means ahead of said gathering wheels, said gusset area creasing means extending into said substantially horizontal plane for engaging the gusset areas of the blank and biasing the gusset areas from said substantially horizontal plane preparatory to said gathering of the gusset areas.

22. The apparatus of claim 20 comprising panel creasing means, said panel creasing means extending into said substantially horizontal plane for engaging the blank and biasing the blank from said substantially horizontal plane preparatory to said folding the blank at the gussets.

23. The apparatus of claim 20 comprising:

(a) gusset area creasing means ahead of said gathering wheels, said gusset area creasing means extending into said substantially horizontal plane for engaging the gusset areas of the blank and biasing the gusset areas from said substantially horizontal plane preparatory to said gathering of the gusset areas; and (b) panel creasing means, said panel creasing means extending into said substantially horizontal plane for engaging the blank and biasing the blank from said substantially horizontal plane preparatory to said folding the blank the gussets.

24. The apparatus of claim 20 comprising stabilizing means for engaging the blank and maintaining the blank in said linear path.

25. The apparatus of claim 24 comprising gusset area creasing means ahead of said gathering wheels, said gusset area creasing means extending into said substantially horizontal plane for engaging the gusset areas of the blank and biasing the gusset areas from said substantially horizontal plane preparatory to said gathering of the gusset areas.

26. The apparatus of claim 24 comprising panel creasing means, said panel creasing means extending into said substantially horizontal plane for engaging the blank and biasing the blank from said substantially horizontal plane preparatory to said folding the blank at the gussets.

27. The apparatus of claim 24 comprising:

(a) gusset area creasing means ahead of said gathering wheels, said gusset area creasing means extending into said substantially horizontal plane for engaging the gusset areas of the blank and biasing the gusset areas from said substantially horizontal plane preparatory to said gathering of the gusset areas; and (b) panel creasing means, said panel creasing means extending into said substantially horizontal plane for engaging the blank and biasing the blank from said substantially horizontal plane preparatory to said folding the blank at the gussets.

* * * * *